US005138224A

United States Patent [19]

Goldburt et al.

[11] Patent Number: 5,138,224

[45] Date of Patent: Aug. 11, 1992

[54] FLUORESCENT LOW PRESSURE DISCHARGE LAMP HAVING SINTERED ELECTRODES

[75] Inventors: Efim S. Goldburt, Briarcliff Manor, N.Y.; Wim M. Hellebrekers, Morgantown, W. Va.

[73] Assignee: North American Philips Corporation, New York, N.Y.

[21] Appl. No.: 624,387

[22] Filed: Dec. 4, 1990

[51] Int. Cl.[5] ..... H01J 61/067; H01J 61/42

[52] U.S. Cl. ..... 313/491; 313/346 R; 313/630; 313/631; 313/633

[58] Field of Search ..... 313/491, 630, 346 DC, 313/346 R, 631, 633, 346 R, 311

[56] References Cited

U.S. PATENT DOCUMENTS

| | | | |
|---|---|---|---|
| 2,389,060 | 11/1945 | Kurtz | 313/346 DC |
| 3,563,797 | 2/1971 | Young et al. | 313/491 |
| 3,766,423 | 10/1973 | Menelly | 313/311 |
| 4,303,848 | 12/1981 | Shimizu et al. | 313/311 |

*Primary Examiner*—Donald J. Yusko
*Assistant Examiner*—Andrew M. Hill
*Attorney, Agent, or Firm*—Norman N. Spain

[57] ABSTRACT

A fluorescent low pressure discharge lamp is provided with a sintered electrode consisting of about 50% to 90% by weight of W and the remainder BaO or a mixture of BaO, CaO and SrO and an oxide of Y, Zr, Hf or an oxide of the rare earths.

16 Claims, 1 Drawing Sheet

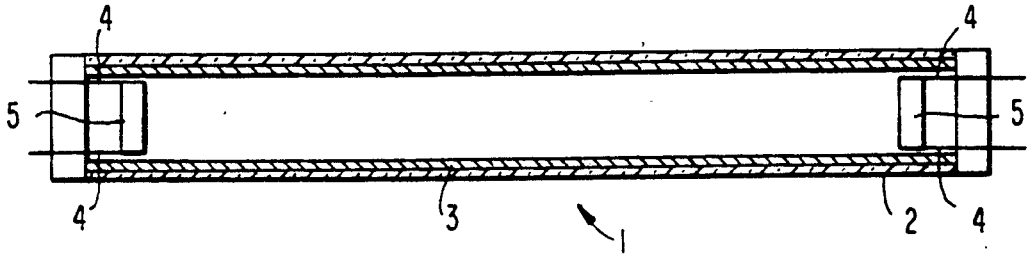
4
4
5
5
4
3
1
2
4

FLUORESCENT LOW PRESSURE DISCHARGE LAMP HAVING SINTERED ELECTRODES

BACKGROUND OF THE INVENTION

This invention relates to a low pressure discharge lamp and particularly to a fluorescent low pressure discharge lamp.

In the known low pressure discharge lamps, the electron emissive electrodes that are employed have a coil structure in which the electron emissive material is provided as a coating on a coiled tungsten wire.

A problem with such an electrode is that it is difficult to provide an adequate control of the amount of emissive material provided on the coiled tungsten wire. As a result, it is very difficult to control the life distribution of the lamps so as to manufacture lamps having a narrowly controlled life distribution. This is because the lamp life is very sensitive to the quantity of emissive material provided on the electrode. Since it is almost impossible to uniformly control amounts of emissive material provided on a coated tungsten wire electrode it is difficult to manufacture lamps having an adequately narrow life distribution.

Another problem exists in that fact that due to the physical nature of the electrode employing a tungsten coil, it is impossible to fabricate the electrode into a particularly desired shape.

Further, fabricating an electrode in which the emissive material is loaded on to a double helix electrode, such as the ones presently employed, is a rather difficult operation and requires expensive equipment.

SUMMARY OF THE INVENTION

It is an object of this invention to provide an improved low pressure discharge lamp particularly an improved fluorescent low pressure discharge lamp.

It is another object of this invention to provide a fluorescent low pressure discharge lamp having an improved electrode.

These and other objects of the invention will be apparent from the description that follows.

According to the invention, it has been found that low pressure discharge lamps, particularly fluorescent low pressure discharge lamps, of highly improved characteristics may be manufactured by employing as the electrode, a sintered electrode consisting of about 50% to 90% by weight of tungsten, 5 to 25% by weight of barium oxide or approximately a 1:1:1 by weight mixture of barium oxide, calcium oxide and strontium oxide and 5–25% by weight of a metal oxide selected from the group consisting of the oxides of yttrium, zirconium, hafnium and of the rare earth and having a porosity of less than about 10% and a resistance of greater than 1 ohm.

BRIEF DESCRIPTION OF THE DRAWINGS

The sole FIGURE of the drawings is a cross-sectional view of a fluorescent low pressure discharge lamp of the invention employing a sintered electrode.

DETAILED DESCRIPTION OF THE INVENTION

While the use of sintered electrodes in discharge lamps is known, the lamps in which sintered electrodes have been applied have been high pressure discharge lamps. Such a lamp is shown for example in Shimizu et al, U.S. Pat. No. 4,303,848.

However, while the low pressure discharge lamps of the invention pass a heater current through the electrodes before arc formation (hot cathode operation), therefore requiring the resistance of the electrodes to be high, no heater current is passed through electrodes employed in the high pressure lamps of this patent. Therefore for these lamps it is not of importance that the electrodes have a high resistance. In fact, preferably the electrodes have a low resistance.

Iwaya et al, U.S. Pat. No. 4,808,883 shows a discharge lamp containing an electrode formed of a semiconductor ceramic material. The electrode in this lamp, unlike the lamp of the invention, does not contain tungsten as the major ingredient but only in an amount up to 0.8 mol %.

Menelly, U.S. Pat. No. 3,766,423, shows low pressure mercury vapor discharge lamps containing hot cathode electrodes formed by mixing tungsten with oxides of barium or with mixtures of oxides of barium, calcium and strontium. However no yttrium oxide is present. In addition, pressing and sintering is not carried out so as to produce an electrode having a porosity of less than about 10% in this patent. But sintering is carried out in such a manner that the electrode produced has a density gradient containing 80% voids in the surface of electrodes extending down 10% voids in the central portion of the electrode. As a result it has been found that such electrodes are very fragile and difficult to degas.

While any metal oxide of the group consisting of the oxides of yttrium, zirconium, neodymium and hafnium may be employed, it is found that best results are achieved when the metal oxide is $Y_2O_3$.

Preferably, the lamp is made from a mixture of 50 to 80% by weight of tungsten, 10 to 25% by weight of yttrium oxide and 10 to 25% of barium oxide, the particle sizes of these ingredients being 0.05–10 μm.

While the electrodes may have any desired shape they are conveniently rod-shaped with a length of at least 5 mm with a length of up to about 30 mm and preferably up to about 15 or 20 mm. Preferably the thickness of the rod is 0.5–2 mm.

The electrodes are manufactured by pressing and sintering mixtures of powders of tungsten and the oxides or the tungsten powder may be first coated with the oxides by a solid-gel technique and the coated powders are then pressed and sintered.

Pressing is generally carried out by isostatic pressing at a pressure of about 8,000–38,000 psi.

Sintering is carried out in a reducing atmosphere, preferably in atmosphere containing up to about 5% of hydrogen in an inert gas such as helium at a temperature of about 1600° C.–2200° C. for 5 minutes to 1 hour.

While the electrodes may be directly pressed and sintered into bars, the electrodes may be first formed as sintered pellets, which pellets are then cut into bars of desired size.

The electrodes are directly connected to the current lead-in wires, for example by point welding.

Preferably the lamp is a low pressure mercury vapor discharge lamp containing a small amount of mercury and a noble gas at a pressure of 1 to 10 torr.

By use of the sintered electrodes, it has been found that it is possible to more closely control the life expectancy of the lamp. Further, because of the greater ease of fabrication, the cost of the manufacturing electrodes and, therefore, the cost of the lamp is greatly reduced as compared with the a lamp employing a coiled electrode. Additionally the electrodes of the invention have relatively high resistance (greater than 1 ohm) thus requiring use of a minimum cathode current. Further, the lamps of the invention exhibit a relatively stable discharge.

For a greater understanding the invention will now be described with reference to the sole figure of the drawing and the following example.

EXAMPLE 80 weight percent of tungsten of a particle size of 0.4 μm was coated with 10 percent by weight of yttrium oxide and 10 percent by weight of barium oxide.

The tungsten powder was coated with the yttrium oxide and the barium oxide employing a sol-gel technique. In carrying out this technique the tungsten powder was dispersed in a mixture of yttrium isopropoxide and barium butoxide in organic solvents in concentrations so as to provide 10 percent by weight of yttrium oxide and 10 percent by weight of barium oxide. The mixture was then formed into a dispersion and the resultant dispersion was heated at a temperature of about 90° C. to remove solvents. The resultant coated powder was then fired at a temperature of about 620° C. for two hours in a nitrogen atmosphere containing about 2% of hydrogen.

The powder was then formed into pellets (1.4 mm thick and 25 mm in diameter) by pressing at a pressure of about 19000 psi. The pellets were then sintered at 2000° C. for about 1 hour in an atmosphere of 95% helium and 5% hydrogen. The resultant pellets were then cut into bars of dimensions of 0.9×1.0×18 mm.

The resultant bars had porosities of less than 10% at a resistance of 2–4 ohms.

A fluorescent low pressure mercury discharge lamp 1 having a tubular shaped glass envelope 2 the inside surface for which envelope was provided with a light emitting phosphor layer 3 was provided at opposite ends of the envelope with two pairs of current lead-in wires 4. Between each pair of current lead-in wires a rod 5 prepared by the previous example was connected by welding. The rods 5 were positioned so that their axis were perpendicular to the axis of the envelope. The lamp was filled with about 2 torr of argon and a small amount of mercuy.

The following tests were carried out with this lamp. Employing a DC power supply (600 V, 1A) and employing a resistor as a ballast a lamp voltage and current were monitored for different heating currents while the lamp was in an arc mode and carrying the cathode current.

The time between the measurements was about two minutes and the ambient temperature was about 22° C. The results are shown in the following table.

TABLE 1

Lamp Voltage as Function of Lamp Current at Various Cathode Heating Currents

| | Cathode Current (A) | | | | |
|---|---|---|---|---|---|
| Lamp Current (mA) | 2.2 | 2.0 | 1.8 | 1.6 | 1.5 |
| 200 | 123 | | | | |
| 250 | 118 | | | | |
| 300 | 114 | 115.5 | | | |
| 350 | 110 | 111 | 115 | | |
| 400 | 107 | 108 | 110 | 115 | 112 |
| 425 | 106 | 106.5 | 109 | 113.5 | 111 |
| 450 | 105 | 105 | 107 | 112 | 109 |

TABLE 1-continued

Lamp Voltage as Function of Lamp Current at Various Cathode Heating Currents

| | Cathode Current (A) | | | | |
|---|---|---|---|---|---|
| Lamp Current (mA) | 2.2 | 2.0 | 1.8 | 1.6 | 1.5 |
| 475 | 104 | 104 | 106 | 109 | 108 |
| 495 | 103 | 103 | 106 | 109 | 107 |

The values shown clearly indicate that the discharge provided by this lamp was stable at a wide range of cathode current and lamp currents.

The relationship between cathode current and cathode voltage is shown in the following table.

TABLE 2

10% BaO Cathode I-V Characteristics

| Cathode Current A | Cathode Voltage V |
|---|---|
| .1 | .05 |
| .2 | .08 |
| .3 | .14 |
| .4 | .19 |
| 1.0 | .63 |
| 1.5 | 1.58 |
| 1.8 | 2.08 |
| 2.0 | 2.42 |
| 2.2 | 2.79 |
| 2.4 | 3.11 |
| 2.6 | 3.37 |
| 2.8 | 3.68 |

This table shows that the cold resistance of the cathode was about 0.5 ohms and that the resistance of the cathode was about 1.31 ohms at 2.8 A.

The lamp was again started and the lamp current $I_{LA}$ was about 400 mA to 150 mA. At the latter current the discharge to OA. The discharge was stable. The lamp current was reduced from 400 mA to 150 mA. At the latter current the discharge became unstable. The results are shown in the following table.

TABLE 3

Lamp Voltage and Current at Various Cathode Currents

| Cathode Current A | Lamp Current mA | Lamp Voltage V |
|---|---|---|
| 2.2 | 400 | 109 |
| 0.6 | 400 | 114 |
| 0.4 | 400 | 114 |
| 0 | 400 | 116 |
| 0 | 350 | 120 |
| 0 | 300 | 126 |
| 0 | 250 | 132 |
| 0 | 200 | 144 |
| 0 | 150 | 170 |

The discharge was stable until the lamp current was reduced to 150 mA. Thus the discharge provided in the lamp was stable between a wide range of lamp currents.

We claim:

1. A fluorescent low pressure discharge lamp comprising a transparent discharge tube, a luminescent material provided on inner surface of said tube, two pairs of electric lead-in wires extending into opposite ends of said tube, a pair of opposing sintered electrodes provided in said tube, each electrode being directly connected to one of the said pairs of lead-in wires and being a sintered shaped mixture of inorganic material consisting of about 50%–90% by weight of W, 5–25% by weight of BaO or of a 1:1:1 by weight mixture of BaO, CaO and SrO and 5–25% by weight of a metal oxide selected from the group consisting of the oxides of Y, Zr, Hf and the rare earths and having a porosity of less than about 10% and a resistance of greater than 1 ohm and an ionizable material provided in said tube.

2. The lamp of claim 1 wherein the metal oxide is $Y_2O_3$.

3. The lamp of claim 2 wherein the lamp is a low pressure mercury vapor discharge lamp provided with a noble gas at a pressure of 1 to 10 torrs and a small amount of mercury.

4. The lamp of claim 3 wherein the electrodes are pressed and sintered mixtures of about 50–80% by weight of W, 10–25% by weight of $Y_2O_3$ and 10–25% by weight of BaO.

5. The lamp of claim 4 wherein the electrodes are rod-shaped with a length of at least 5 mm.

6. The lamp of claim 5 wherein the electrodes are rod-shaped with a length of at least about 20 mm and a thickness of 0.5–2 mm.

7. The lamp of claim 4 wherein the electrodes are formed by pressing the mixture of inorganic material and sintering the pressed mixture in an atmosphere containing hydrogen in an amount of up to about 5% at a temperature of 1600° C.–2200° C. for 5 minutes to 1 hour.

8. The lamp of claim 7 wherein the mixture of inorganic material is formed into a presintered body by pressing at a pressure of 8000–38000 psi.

9. The lamp of claim 6 wherein the pressed and sintered mixtures are formed of mixtures consisting essentially of about 80% by weight of W, about 10% by weight of BaO and about 10% by weight of $Y_2O_3$.

10. The lamp of claim 8 wherein the electrodes are formed by pressing the mixtures of inorganic material into rod-shaped bodies by pressing at a pressure of 8000–38000 psi and then sintering the resultant presintered bodies in an atmosphere of up to or about 5% of hydrogen in helium at a temperature of about 1800° C.–2200° C. for 5 minutes to 1 hour.

11. The lamp of claim 10 wherein the presintered bodies are sintered at a temperature of about 2000° C. for about 1 hour.

12. The lamp of claim 10 wherein in a mixture employed in forming the presintered rod, the particle size of W is 0.05–10 μm, the particle size of BaO is 0.0514 10 μm and the particle size of $Y_2O_3$ is 0.05–10 μm.

13. The lamp of claim 12 wherein the presintered bodies are rods of a thickness of about 0.05–2 mm and a length of at least 5 mm.

14. The lamp of claim 1 wherein the inorganic material consists of tungsten particles provided with essentially uniform coatings of BaO or a 1:1:1 mixture of BaO, SrO and CaO and an oxide selected from the group consisting of Y, Zr, Hf and the rare earth.

15. The lamp of claim 14 wherein the tungsten particles are provided with coatings of BaO and $Y_2O_3$.

16. The lamp of claim 15 wherein the coatings are provided by a sol-gel method.

* * * * *